US010330323B2

(12) United States Patent
Kim et al.

(10) Patent No.: US 10,330,323 B2
(45) Date of Patent: Jun. 25, 2019

(54) COOKING DEVICE

(71) Applicant: LG ELECTRONICS INC., Seoul (KR)

(72) Inventors: Seungyoun Kim, Seoul (KR); Jongho Lee, Seoul (KR); Youngsoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 317 days.

(21) Appl. No.: 15/195,651

(22) Filed: Jun. 28, 2016

(65) Prior Publication Data

US 2017/0082294 A1 Mar. 23, 2017

(30) Foreign Application Priority Data

Sep. 21, 2015 (KR) ..... 10-2015-0133018

(51) Int. Cl.

| | |
|---|---|
| ***F24C 3/00*** | (2006.01) |
| ***F24C 3/08*** | (2006.01) |
| ***F24C 3/12*** | (2006.01) |
| ***F24C 15/32*** | (2006.01) |
| ***F24C 15/34*** | (2006.01) |

(52) U.S. Cl.

CPC ..... *F24C 3/082* (2013.01); *F24C 3/004* (2013.01); *F24C 3/087* (2013.01); *F24C 3/122* (2013.01); *F24C 15/322* (2013.01); *F24C 15/34* (2013.01)

(58) Field of Classification Search

None

See application file for complete search history.

(56) References Cited

U.S. PATENT DOCUMENTS

| | | | | | |
|---|---|---|---|---|---|
| 3,698,377 | A | * | 10/1972 | Smith | F24C 15/322 126/21 A |
| 3,719,180 | A | * | 3/1973 | Pere | A21B 1/26 126/21 A |
| 4,211,909 | A | | 7/1980 | Yoshida et al. | |
| 4,498,453 | A | * | 2/1985 | Ueda | F24C 15/322 126/21 A |
| 4,627,409 | A | * | 12/1986 | Kagomoto | F24C 15/322 126/19 R |
| 4,648,377 | A | * | 3/1987 | Van Camp | F24C 15/322 126/21 A |
| 4,813,398 | A | * | 3/1989 | Savage | F24C 15/322 126/21 A |
| 4,823,766 | A | * | 4/1989 | Violi | F24C 15/327 126/20 |

(Continued)

FOREIGN PATENT DOCUMENTS

| | | | |
|---|---|---|---|
| CA | 1114262 | A | 12/1981 |
| EP | 0 105 931 | A1 | 4/1984 |

(Continued)

*Primary Examiner* — Avinash A Savani
*Assistant Examiner* — Martha M Becton
(74) *Attorney, Agent, or Firm* — Dentons US LLP

(57) ABSTRACT

A cooking device including a frame that defines a cooking chamber, a burner cover provided in the frame to form a combustion chamber and includes an opening for flowing air, a burner provided inside the combustion chamber, and a barrier member provided between the burner cover and the frame in order to prevent heat of air discharged from the combustion chamber from being delivered to the frame.

20 Claims, 10 Drawing Sheets

(56) References Cited

U.S. PATENT DOCUMENTS 4,867,132 A * 9/1989 Yencha ..... F24C 15/322 126/21 A
4,909,236 A * 3/1990 Del Fabbro ..... F24C 15/322 126/21 A
5,121,737 A * 6/1992 Yencha, III ..... F24C 15/322 126/21 A
5,471,972 A * 12/1995 Corliss, II ..... F24C 14/025 126/21 A
5,568,803 A * 10/1996 Brown ..... F24C 15/322 126/21 A
6,371,104 B1 * 4/2002 Voohris ..... F24C 15/322 126/21 A
7,071,448 B1 * 7/2006 Kim ..... F24C 15/16 126/333
9,534,791 B2 * 1/2017 Wie ..... F24C 3/025
9,874,357 B2 * 1/2018 Wie ..... H05K 999/99
9,939,159 B2 * 4/2018 Wie ..... F24C 3/004
2003/0164167 A1 * 9/2003 Van Vleet ..... F24C 3/006 126/512
2005/0056267 A1 * 3/2005 Levi ..... F24C 15/322 126/21 R
2006/0278214 A1 * 12/2006 Park ..... F24C 15/006 126/273 R
2009/0032521 A1 * 2/2009 Kim ..... F24C 15/18 219/400
2009/0045184 A1 * 2/2009 Nam ..... F24C 15/322 219/400
2009/0104037 A1 * 4/2009 Kellermann ..... F04D 29/263 416/204 R
2010/0006085 A1 * 1/2010 Thomas ..... F24C 15/325 126/21 A
2010/0263656 A1 * 10/2010 Ryu ..... F23D 14/065 126/39 E
2013/0333685 A1 * 12/2013 Jeong ..... F24C 15/322 126/21 A
2014/0144422 A1 * 5/2014 Wie ..... F24C 3/087 126/39 E
2014/0144423 A1 * 5/2014 Wie ..... F24C 15/322 126/39 E
2015/0285509 A1 * 10/2015 Wie ..... F24C 3/004 126/273 R
2015/0285510 A1 * 10/2015 Wie ..... F24C 3/025 126/273 R
2015/0285514 A1 * 10/2015 Wie ..... H05K 999/99 126/21 A

FOREIGN PATENT DOCUMENTS

JP 8-285285 A 11/1996
JP 2013-217630 A 10/2013
KR 10-2004-0088708 A 10/2004
KR 10-2014-0067749 A 6/2014

* cited by examiner

COOKING DEVICE

CROSS-REFERENCE TO RELATED APPLICATION

The present application claims priority under 35 U.S.C. 119 and 35 U.S.C. 365 to Korean Patent Application No. 10-2015-0133018 (filed on Sep. 21, 2015), which is hereby incorporated by reference in its entirety.

BACKGROUND

A cooking device is a device for cooking food using a heating source.

One type of conventional cooking device is a gas oven range, such as described in Korean Patent Publication No. 10-2014-0067749 (published on Jun. 5, 2014). The gas oven range described therein includes a burner being supported by a support plate. The support plate is provided at the rear wall of a cavity of the oven.

Air heated by the burner passes through an opening in the support plate and flows into a space between the support plate and the rear wall of the cavity. An inner circumferential surface of the cavity includes an enamel coating layer to protect the inner circumferential surface of the cavity from heat or impact. However, with this configuration, the heated air passing through the opening in the support plate comes in direct contact the rear wall of the cavity, which may cause the enamel coating layer to break or damage. The present disclosure solves this problem.

SUMMARY

The present disclosure provides a cooking device that prevents an enamel coating layer from breaking as a result of air heated by a burner. Additionally, the present disclosure provides a cooking device capable of causing air heated by a burner to smoothly flow to a cooking chamber.

According to an aspect of the present disclosure, a cooking device includes: a frame that defines a cooking chamber; a burner cover provided inside the frame to form a combustion chamber, the burner cover having an opening for air to flow; a burner provided inside the combustion chamber; and a barrier member provided between the burner cover and the frame, wherein the barrier member prevents air that is discharged from the combustion chamber from contacting the frame.

According to yet another aspect of the present disclosure, a cooking device includes: a frame that defines a cooking chamber; a barrier member attached to the frame; a burner cover fastened to the barrier member and spaced apart from the frame; a combustion chamber having a burner provided therein; a fan motor provided outside of the frame, the fan motor having a shaft connected thereto that passes through the frame and the barrier member; and a fan connected to the shaft of the fan motor, the fan being disposed between the burner cover and the frame.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE EMBODIMENTS

Figure 1:
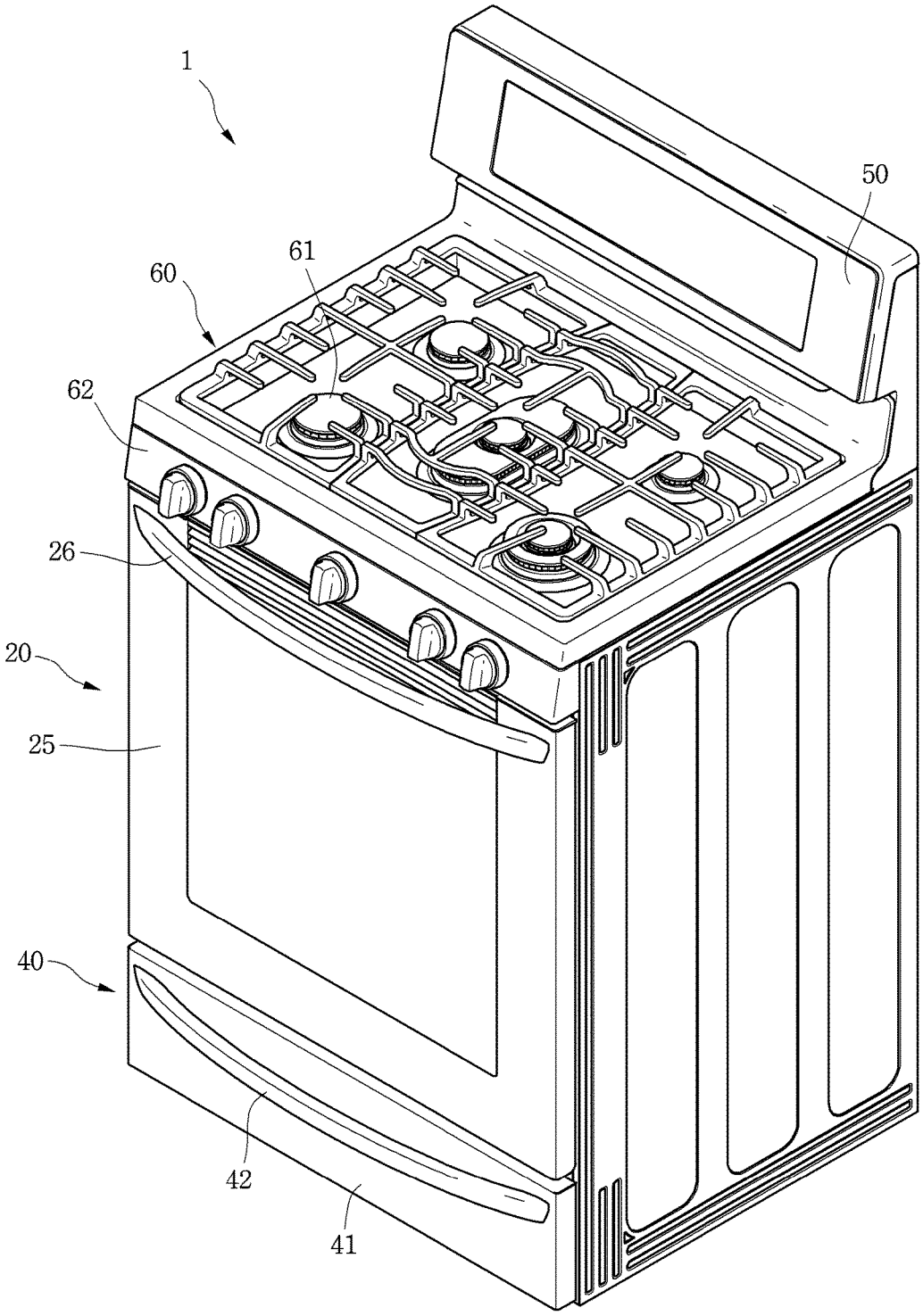
FIG. 1 is a perspective view of a cooking device according to an embodiment of the present disclosure.

Reference will now be made in detail to embodiments of the present disclosure, examples of which are illustrated in the accompanying drawings.

Hereinafter, exemplary embodiments of the present disclosure will be described with reference to the accompanying drawings. Regarding the reference numerals assigned to the elements in the drawings, it should be noted that the same elements may be designated by the same reference numerals, wherever possible, even though they are shown in different drawings. Also, in the description of embodiments, detailed description of well-known related structures or functions may be omitted when it is deemed that such description may cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected," "coupled," and "joined" to the latter via another component.

Figure 2:
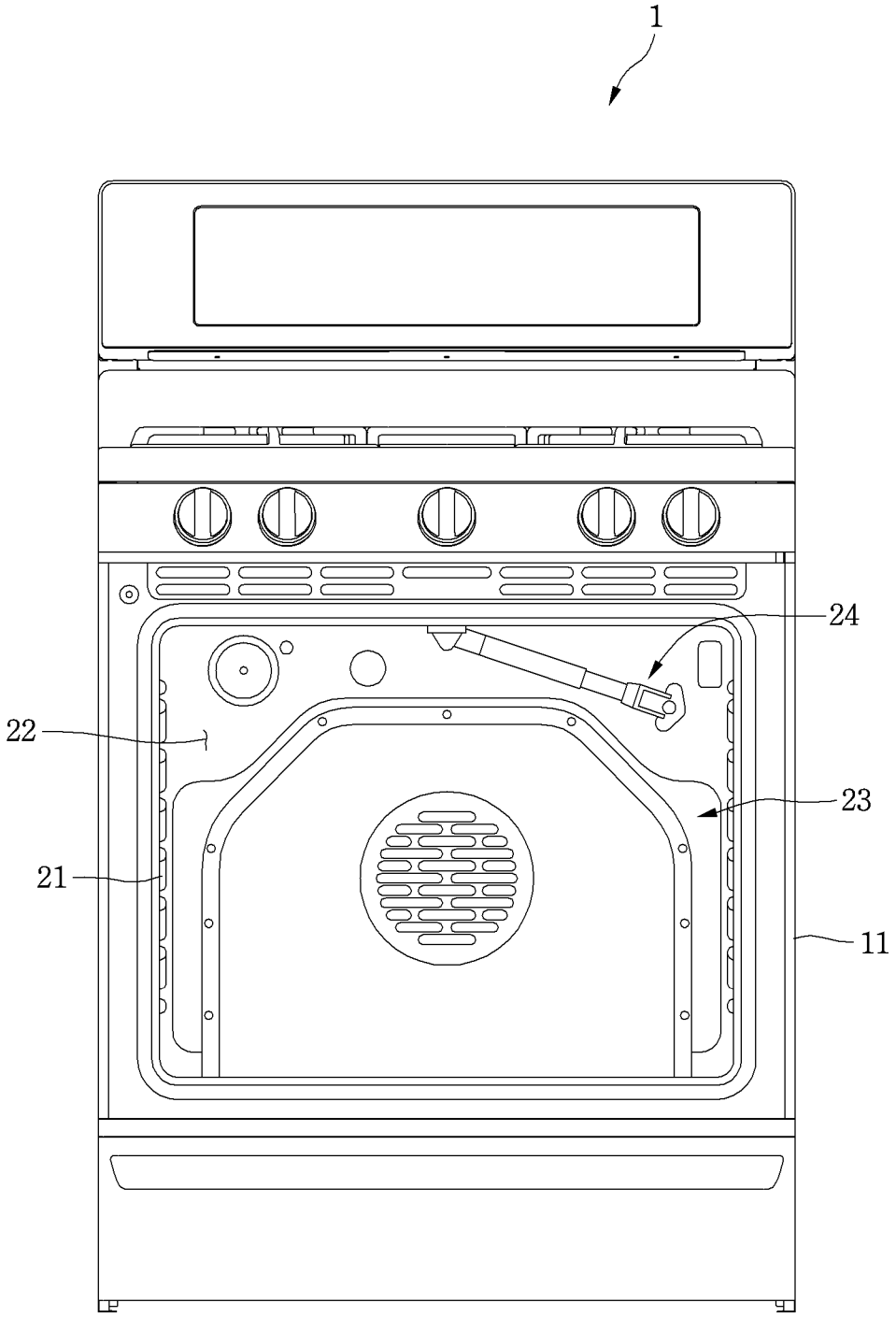
FIG. 2 is a front view of a cooking device according to an embodiment of the present disclosure, in a state in which a door of the cooking device is removed.

FIG. 1 is a perspective view of a cooking device according to an embodiment of the present disclosure, and FIG. 2 is a front view when a door is removed from the cooking device according to the embodiment of the present disclosure.

Referring to FIGS. 1 and 2, a cooking device 1 may include an oven unit 20. As shown, the cooking device 1 may further include a cook-top unit 60, a drawer unit 40, a control unit 50, and/or an outer case 11. The outer case 11 may cover both side surfaces and rear surfaces of the oven unit 20 and the drawer unit 40. It is understood, however, that the cook-top unit 60 and the drawer unit 40 may be omitted.

The cook-top unit 60, the oven unit 20, and the drawer unit 40 may be provided at an upper portion, a center portion, and a lower portion of the cooking device 1, respectively. Further, the control unit 50 may be provided at a rear portion of an upper surface of the cooking device 1.

The cook-top unit 60 may include a plurality of cook-top burners 61, which may be used to heat items or cook food by burning a gas. An operational unit 62 to operate the plurality of cook-top burners 61 may be provided at a front end of the cook-top unit 60. Alternatively, the operational unit 62 may be provided at an upper surface of the cook-top unit 60.

According to another embodiment of the present disclosure, the cook-top unit 60 may include one or more electric heaters. However, the one or more electric heaters may not be exposed to the outside of the cook-top unit 60.

The oven unit 20 may include a frame 21 that forms a cooking chamber 22 in which the heating or cooking of food is performed. For example, the frame 21 may have a rectangular parallelepiped shape of which a front surface is open, but the frame is not limited to such shape.

The oven unit 20 may further include a burner assembly 23 to heat or cook food accommodated in the cooking chamber 22. The oven unit 20 may further include an upper burner 24. The burner assembly 23 and the upper burner 24 may simultaneously heat the food, or any one of the burner assembly 23 and the upper burner 24 may heat the food. For example, the upper burner 24 may provide heat to the food from above the food in the frame 21, and the burner assembly 23 may be provided at the rear of the food in the frame 21. The upper burner 24 may be installed at an upper wall of the frame 21, and the burner assembly 23 may be installed at a rear wall of the frame 21.

The oven unit 20 may further include a door 25 to provide access to the cooking chamber 22. The door 25 may be rotatably connected to the cooking device 1. For example, the door 25 may be a pull-down door such that the door 25 opens and closes the cooking chamber 22 in a pull-down method in which an upper end is vertically rotated about a lower end. It is understood, however, that the door 25 is not limited to any particular configuration or opening/operating method.

The door 25 may further include a door handle 26. For example, the door handle 26 may be gripped by a user hand to rotate the door 25. The door handle 26 may be provided at an upper end of a front surface of the door 25.

The drawer unit 40 functions to maintain the container, in which the food or item is stored, at a predetermined temperature. The drawer unit 40 may include a drawer 41 in which the container is accommodated. The drawer 41 may be inserted into or withdrawn from the cooking device 1 in a sliding method, but is not limited thereto. A handle 42 may be provided at a front surface of the drawer 41 so that a user can pull the drawer in a sliding method.

The control unit 50 may receive an operation signal for operating the cooking device 1, e.g., an operation signal to operate at least one of the cook-top unit 60, the oven unit 20 and the drawer unit 40. Further, the control unit 50 may display a variety of information relating to the operation of the cooking device 1.

Figure 3:
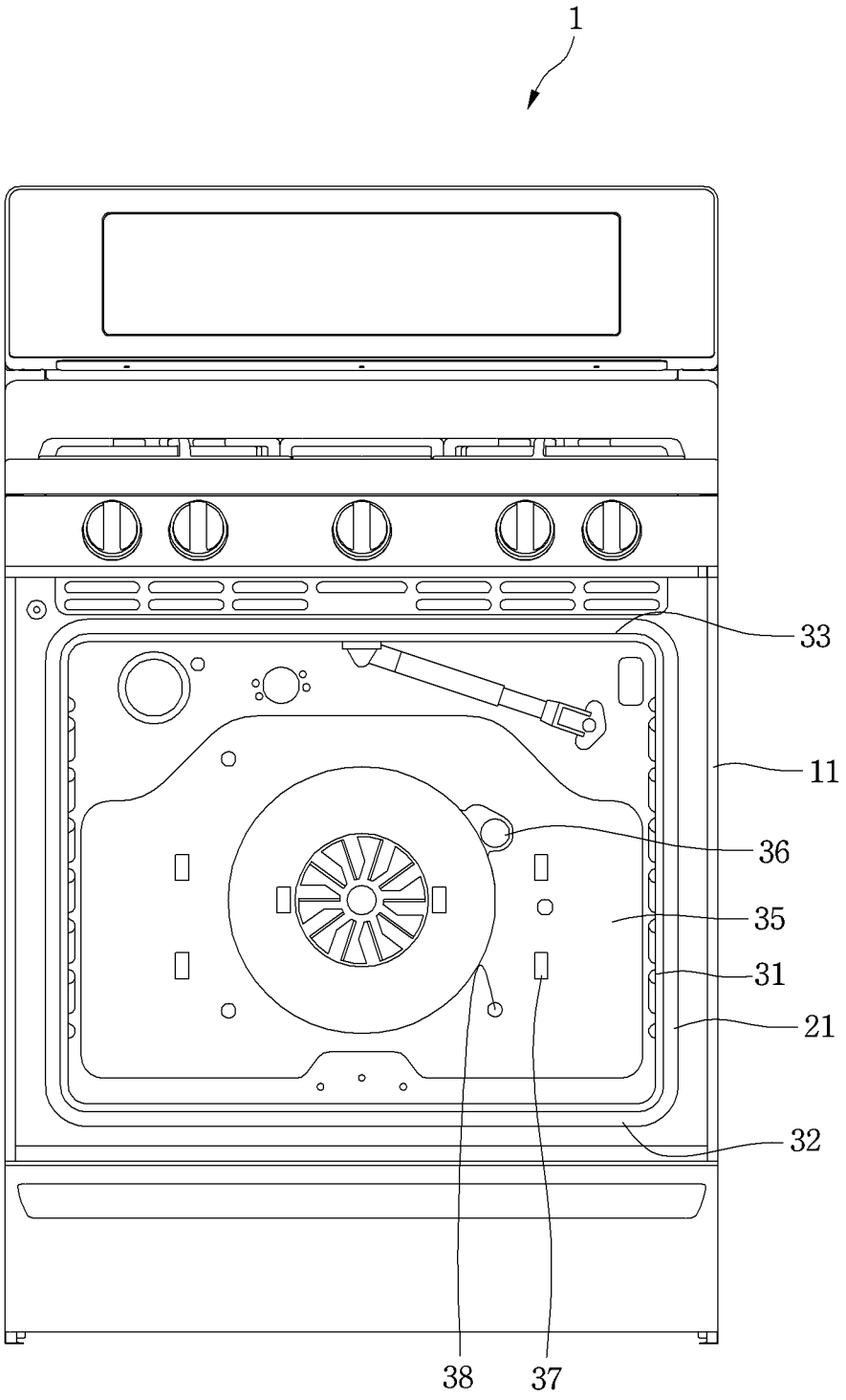
FIG. 3 is a diagram showing a state in which a burner assembly is removed from the embodiment shown in FIG. 2.
Figure 4:
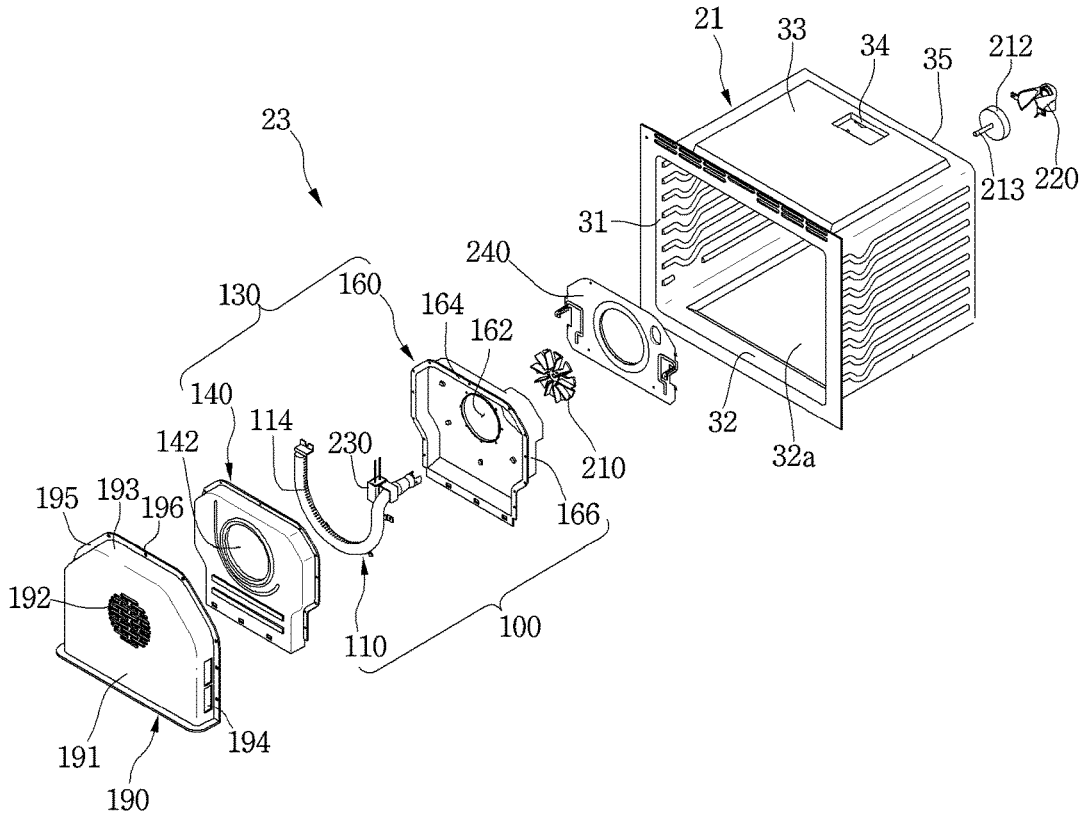
FIG. 4 is an exploded perspective view of a burner assembly according to an embodiment of the present disclosure.
Figure 5:
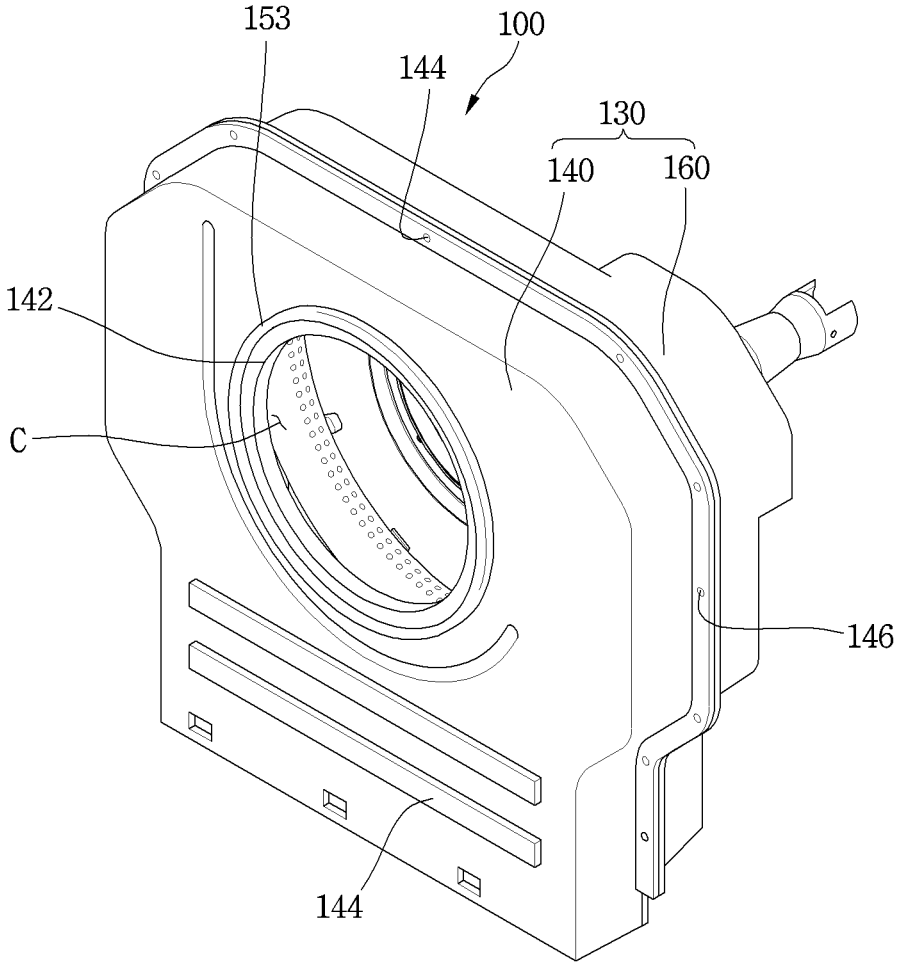
FIG. 5 is a perspective view of a burner device according to an embodiment of the present disclosure.

FIG. 3 is a view illustrating the burner assembly removed from the cooking device shown in FIG. 2, FIG. 4 is an exploded perspective view of the burner assembly, and FIG. 5 is a perspective view of a burner device according to an embodiment of the present disclosure.

Referring to FIGS. 2 through 5, the frame 21 may include two sidewalls 31, a bottom wall 32, an upper wall 33, and a rear wall 35. Here, the term "front" refers to a direction toward a front surface of the cooking device 1, and the term "rear" refers to a direction toward a rear surface of the cooking device 1. Further, in the cooking chamber 22, the term "front" refers to a direction toward the door 25 of the oven unit 20, and the term "rear" refers to a direction toward the rear wall 35 of the frame 21.

The burner assembly 23 may be attached to the rear wall 35 of the frame 21. That is, in the embodiment, since the burner assembly 23 is not located under the frame 21 but is installed at the rear wall 35 of the frame 21, a recessed portion 32*a* recessed downward may be formed at the bottom wall 32 of the frame 21, and thus a capacity of the frame 21 may be increased. Although the above-described burner assembly 23 is provided or installed at the rear wall 35 of the frame 21, it is understood that the burner assembly 23 may instead be provided at any one of both of the sidewalls 31 of the frame 21.

The burner assembly 23 may include a burner device 100. The burner device 100 may include a burner 110 to generate a flame by burning a mixture gas in which the gas and air are mixed, and a burner cover 130 to cover the burner 110.

Both ends of the burner 110 may be spaced apart from each other. The burner 110 may have a non-annular shape.

The burner 110 may comprise a plurality of gas outlet holes 114. For example, the burner 110 may comprise an inner periphery and an outer periphery, and the plurality of gas outlet holes 114 may be defined on the inner periphery of the burner 110, but the burner 110 structure is not limited thereto.

The burner assembly 23 may further include an assembly cover 190 to cover the burner device 100. Additionally, the burner assembly 23 may include a fan 210 and a fan motor 212.

A burner hole 36 through which the burner 110 passes may be formed in the rear wall 35 of the frame 21. For example, the burner 110 may be provided in the frame 21 and a part thereof may pass through the burner hole 36 to be located between the rear wall 35 of the frame 21 and the outer case 11.

An exhaust hole 34 through which an exhaust gas is discharged may be formed in the upper wall 33 of the frame 21. Alternatively, the exhaust hole 34 may be formed in the rear wall 35 or one of both of the sidewalls 31 of the frame 21.

The burner cover 130 defines a combustion chamber C in which gas is burned. A portion of the burner 110 may be provided in the combustion chamber C.

The burner cover 130 may include a first cover 140 and a second cover 160. For example, at least a portion of the first cover 140 may cover the front of the burner 110, and at least a portion of the second cover 160 may cover the rear of the burner 110.

The first cover 140 may include a first opening 142 through which air within the cooking chamber 22 passes, and the second cover may include a second opening 162 through which air passing through the first opening 142 passes.

Additionally, the first cover 140 may include a first cover fastening hole 144 and the second cover 160 may include a second cover fastening hole 146. The first cover 140 and the second cover 160 may be coupled together via a fastening member that is fastened to the cover fastening hole 144.

The first cover 140 may include a first barrier fastening hole 146 and the second cover 160 may include a second barrier fastening hole 166. The fastening member may pass through the barrier fastening holes 146 and 166 and fastened to the barrier member 240. According to the present disclosure, as the fastening member passes through the first cover 140 and the second cover 160, a fastening force of the first cover 140 and the second cover 160 may increase.

The burner device 100 may further include an ignition unit 230 to ignite the mixed gas supplied to the burner 110. For example, the ignition unit 230 may be installed on the burner 110 in the frame 21. When the ignition unit 230 is installed on the burner 110, at least a part of the ignition unit 230 may be located in the burner cover 130.

The fan motor 212 may be provided between the rear wall 35 of the frame 21 and the outer case 11, and the fan 210 may be located in the frame 21. A shaft 213 of the fan motor 212 may pass through the rear wall 35 of the frame 21 and may be coupled to the fan 210. The fan motor 212 may be fixed to the rear wall 35 of the frame 21 or the outer case 11 by a motor mount (not shown).

The assembly cover 190 may protect the burner device 100. The assembly cover 190 may also block or prevent food or the like from contacting the burner device 100.

The assembly cover 190 may include a front plate 191, an extension part 193 extending from the front plate 191 toward the rear wall 35 of the frame 21, and a contact part 195 bent from the extension part 193.

An air suction hole 192 through which air within the cooking chamber 22 is suctioned is provided on the front plate 191, and an air discharge hole 194 through which air heated by the burner device 100 is discharged into the cooking chamber 22 is provided on the extension part 193. In another example, the air discharge hole 194 may be provided on the front plate 191 or provided on each of the front plate 191 and the extension part 193.

Air passing through the air suction hole 192 is introduced into the combustion chamber C via the first opening 142 of the first cover 140.

The contact part 195 may contact the rear wall 35 of the frame 21 when the contact part 195 covers the burner device 100. A coupling hole 196 to which a coupling member (not shown) is coupled may be provided on the contact part 195.

A lower end of the assembly cover 190 may contact the bottom wall 32 of the frame 21 when the assembly cover 190 is coupled to the rear wall 35 of the frame 21 by the coupling member. That is, the front plate 191 and lower ends of the extension part 193 and the contact part 195 may contact the bottom wall 32 of the frame 21. Alternatively, the front plate 191 and the extension part 193 may contact the bottom wall 32 of the frame 21.

Here, the assembly cover 190 may contact the bottom wall 32 of the frame 21 between the recessed portion 32*a* of the bottom wall 32 and the rear wall 35 of the frame 21.

The burner assembly 23 may further include a nozzle holder 220. The nozzle holder 220 may be provided between the rear wall 35 of the frame 21 and the outer case 11. For example, the nozzle holder 220 may be attached to the rear wall 35 of the frame 21. In another example, if an insulator is provided outside of the cavity 21, the nozzle holder 220 may be provided on the insulator. The nozzle holder 220 may be aligned with the burner 110 passing through the rear wall 35 of the frame 21 to spray gas into the burner 110.

The burner device 100 may further include a barrier member 240 to block or reduce heat generated by the burner 110 or air heated by the burner 110 from being delivered to the rear wall 35 of the frame 21. The barrier member 240 may be, for example, provided on the rear wall 35 of the frame 21 and the burner cover 230 may be provided on the barrier member 240.

At least one first fastening hole 37 and at least one second fastening hole 38 for fastening the barrier member 240 may be formed in the rear wall 35 of the frame 21.

The fastening structure of the barrier member 240 will be described below in more detail with reference to the figures.

Figure 6:
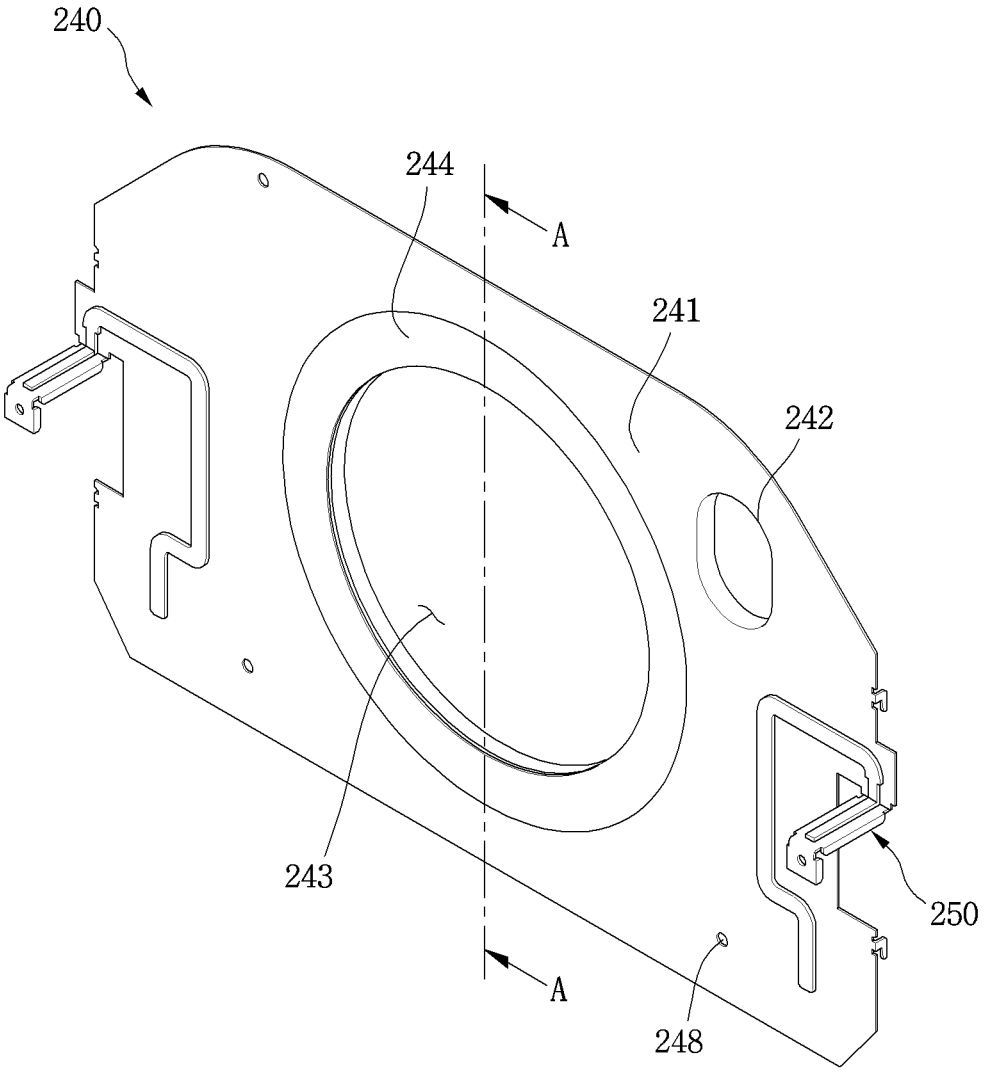
FIG. 6 is a perspective view of a barrier member according to an embodiment of the present disclosure.
Figure 7:
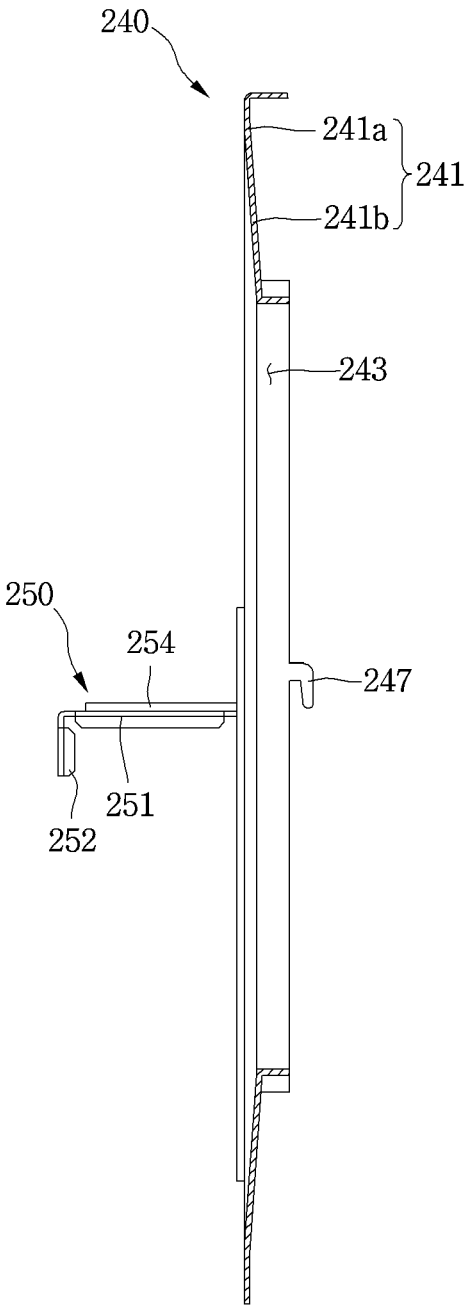
FIG. 7 is a cross-sectional view taken along line A-A of the embodiment shown in FIG. 6.
Figure 8:
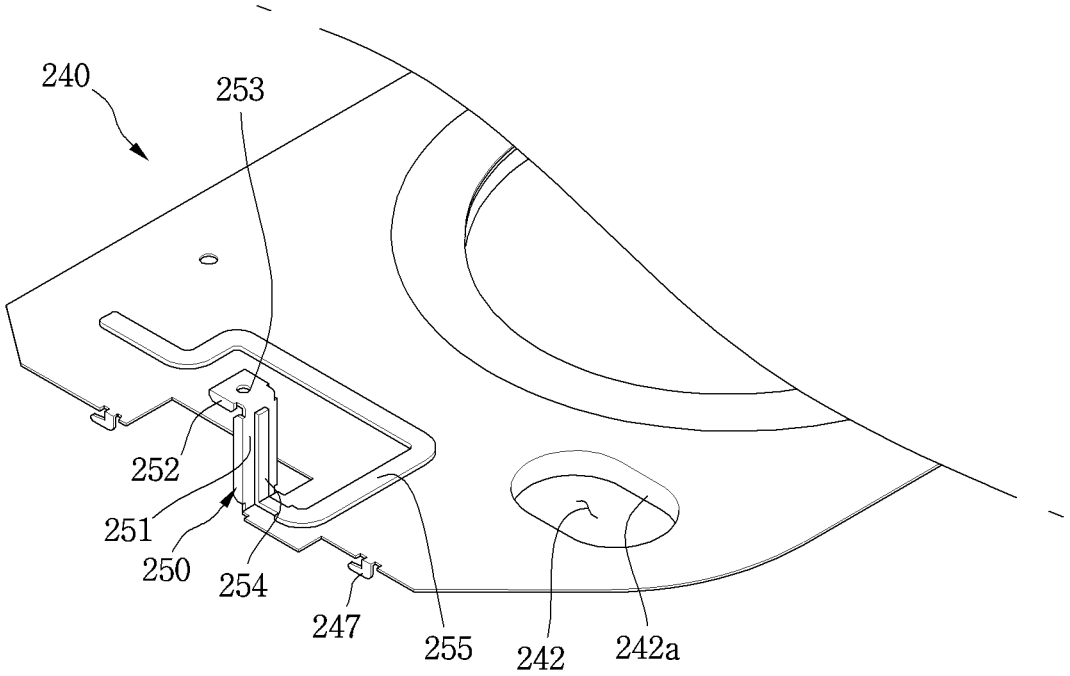
FIG. 8 is a view showing a cover fastener of a barrier member according to an embodiment of the present disclosure.

FIG. 6 is a perspective view of a barrier member according to an embodiment of the present disclosure, FIG. 7 is a cross-sectional view taken along line A-A of FIG. 6, and FIG. 8 is a view showing a cover fastener of a barrier member according to an embodiment of the present disclosure.

Referring to FIG. 3 and FIGS. 6 through 8, the barrier member 240 may include a barrier plate 241 capable of being in contact with the rear wall 35 of the frame 21.

A shaft through-hole 243, through which a shaft 213 of the fan motor 212 passes, may be formed in the barrier plate 241. The diameter of the shaft through-hole 243 may be larger than that the diameter of the fan 210.

The barrier member 240 may be separated from the frame 21 to be drawn out of the cooking chamber 22 when the fan 210 is attached to the shaft 213 of the fan motor 212. In addition, the barrier member 240 may be fastened to the frame 21 without interfering with the fan 210 when the fan 210 is attached to the shaft 213 of the fan motor 212. In addition, the barrier member 240 may be fastened to the frame 21 without interfering with the fan 210 when the fan 210 is attached to the shaft 213 of the fan motor 212. Accordingly, the assembly order of the burner assembly 23 may be diversified, which can improve operation performance and make the structure easier to service.

A burner through-hole 242, through which the burner 110 passes, may be provided in the barrier plate 241.

The burner 110 may pass through the second cover 160, the burner through-hole 242 of the barrier plate 241, and the burner hole 36 of the frame 21, when it is received in the burner cover 130.

A wire (not shown) may be connected to the ignition unit 230 and pass through the burner through-hole 242. For protection, a flange 242*a* may be formed in the barrier plate 241 to prevent the wire from being damaged. For example, the flange 242*a* may be formed by a burring process.

The diameter of the burner through-hole 242 may be less than the diameter of the burner hole 36. The flange 242*a* may be received in the burner hole 36 or may pass through the burner hole 36.

A frame fastening hole 248 to fasten with the frame 21 may be further provided in the barrier plate 241.

The barrier member 240 may further include a cover fastener 250 to fasten with the burner cover 130.

The cover fastener 250 may extend from the barrier plate 241. For example, the cover fastener 250 may be formed by cutting and/or bending a portion of the barrier plate 241. Alternatively, the cover fastener 250 may be manufactured as a separate structure to be fastened to the barrier plate 241.

The cover fastener 250 may include an extension 251 that extends from an end of the barrier plate 241 and a fastening body 252 that is bent from an end of the extension 251 and fastened to the burner cover 130.

Although not limited thereto, the extension 251 and the fastening body 252 may be approximately at a right angle with respect to each other.

To prevent a reduction in the internal volume of the cooking chamber 22 when the burner cover 130 is fastened to the cover fastener 250, the horizontal distance from the shaft through-hole 243 to the second opening 162 of the burner cover 130 may be shorter than the horizontal length of the cover fastener 250.

The fastening body 252 may extend in a vertical direction. A fastening hole 253 may be formed in the fastening body 252. The fastening member passing through the burner cover 130 may be fastened to the fastening hole 253.

A strength reinforcement unit 254 may be provided on the extension 251 to provide strength reinforcement thereto. The strength reinforcement unit 252 may protrude or be recessed to one side by a press working process.

In addition, a strength reinforcement unit 255 may be formed on a part of the barrier plate 241, in which the cover fastener 250 is located, and in the vicinity of the part of the barrier plate. Although not limited thereto, the strength reinforcement unit 254 of the extension 251 and the strength reinforcement unit 254 of the barrier plate 241 may be continuously formed.

The barrier member 240 may further include a frame fastener 247 to fasten with the frame 21. The frame fastener 247 may extend in a direction that is opposite that of the extension direction of the cover fastener 250 in the barrier plate 241. The frame fastener 247 may have a hook shape and may pass through the first fastening hole 37 of the frame 21 to engage with the frame 21.

Meanwhile, the barrier plate 241 may be divided into a vertical part 241*a* and an inclination part 241*b*, and the shaft through-hole 243 may be located in the inclination part 241*b*.

As illustrated, for example, the vertical part 241*a* may be a part that is parallel to a vertical line and the inclination part 241*b* may be inclined from the vertical line by a predetermined angle.

The frame fastening hole 248 and the frame fastener 247 may be located in the vertical part 241*a*.

Figure 9:
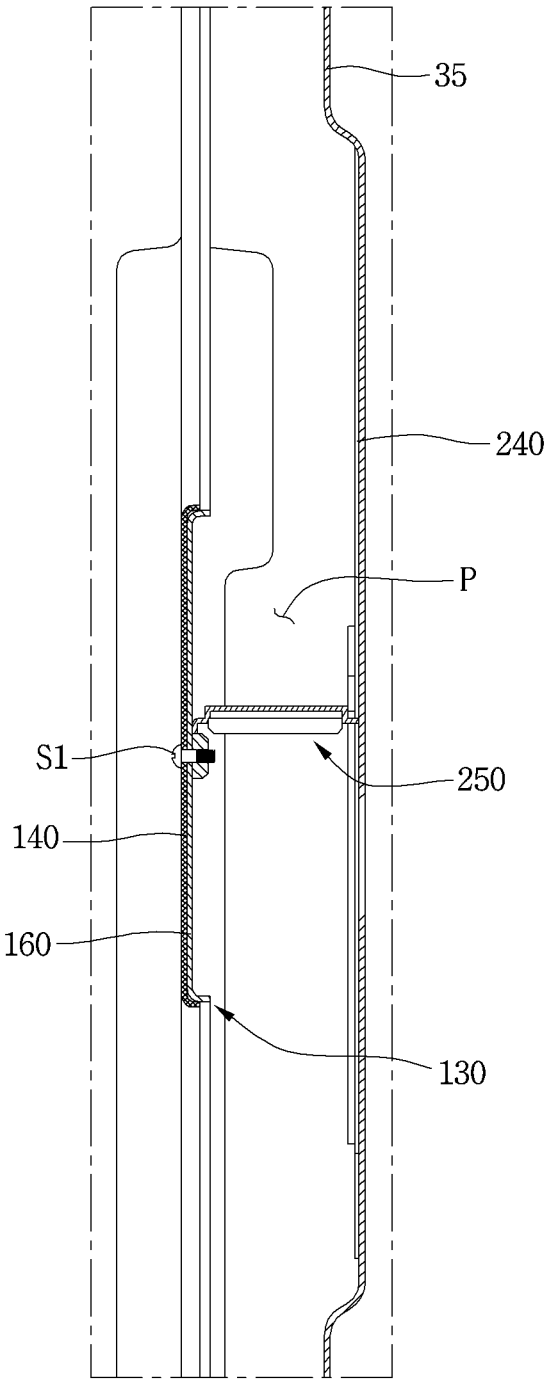
FIG. 9 is a diagram showing a state in which a burner cover is fastened to a barrier member according to an embodiment of the present disclosure.
Figure 10:
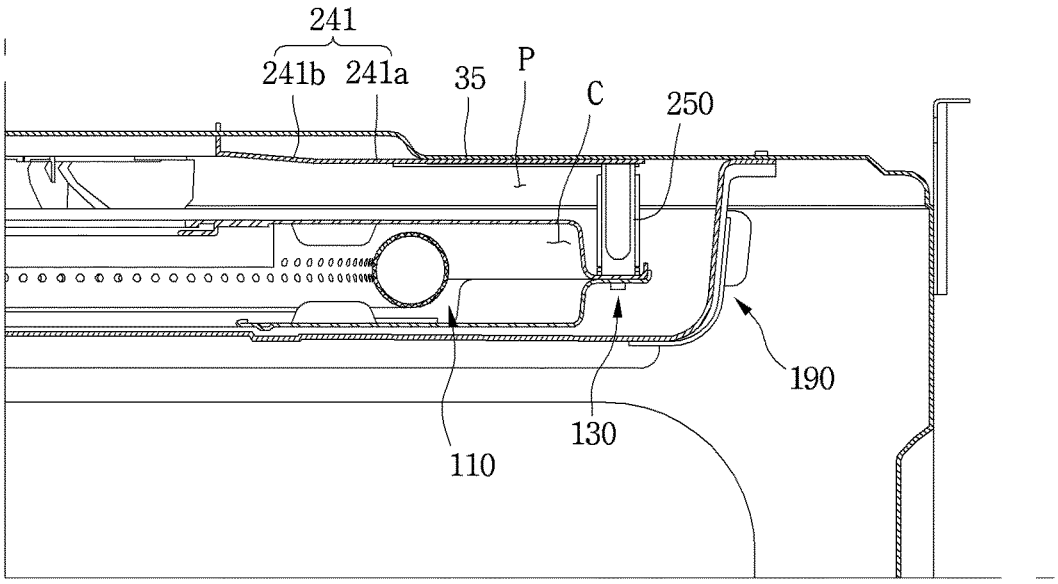
FIG. 10 is a cross-sectional view showing a state in which a burner assembly is fastened to a rear wall of a frame according to an embodiment of the present invention.

FIG. 9 is a diagram showing a state in which a burner cover is fastened to a barrier member according to an embodiment of the present disclosure, and FIG. 10 is a cross-sectional view showing a state in which a burner assembly according is fastened to a rear wall of a frame according to an embodiment of the disclosure.

Referring to FIGS. 9 and 10, the burner cover 130 is fastened to the barrier member 240 by the fastening member S1 when the barrier member 240 is fastened to the rear wall 35 of the frame 21. The burner cover 130 is spaced apart from the barrier plate 241 when the burner cover 130 is fastened to the barrier member 240. Accordingly, an exhaust flow path P along which heated air flows is defined between the burner cover 130 and the barrier plate 241. That is, the barrier plate 241 forms the exhaust flow path P.

In the exhaust flow path P, the flow path of the inclination part 241*b* is larger than the flow path of the vertical part 241*a*. However, the width of the exhaust flow path P may be reduced from the inclination part 241*b* adjacent to the fan 210 (part adjacent to the shaft through-hole) to the vertical part 241*a*.

Air discharged from the burner cover 130 may flow along the exhaust flow path P by the fan 210 and air discharged from the fan 210 may flow along the inclination part 241*b*, thereby improving flowing performance.

Hereinafter, operation of the burner assembly will be described.

Referring to FIGS. 1 to 10, when the burner assembly 23 starts to operate, gas is sprayed from the nozzle holder 220 to the burner 110. Then, air located in the vicinity of the gas inlet of the burner 110 (e.g., air outside the frame) is supplied to the gas inlet of the burner 110 along with gas. The mixed gas is ignited by the ignition unit 230 when it is supplied to the burner 110.

The fan motor 212 may be powered on to rotate the fan 210. When the fan 210 rotates, air within the cooking chamber 22 is introduced into the combustion chamber C through the air suction hole 192 of the assembly cover 190. The air introduced into the combustion chamber C then passes through the inner circumferential surface of the burner 110.

The air introduced into the combustion chamber C is heated by the flame generated by the burner 110 and is discharged from the combustion chamber C. The air discharged from the combustion chamber C flows along the exhaust flow path P between the burner cover 130 and the barrier plate 241. The air is then discharged to the cooking chamber 22 through the air discharge hole 194 of the assembly cover 190.

According to an embodiment of the present disclosure, the burner cover 130 forms an independent combustion chamber C, and the combustion chamber C and the exhaust flow path P are partitioned by the burner cover 130. Thus, air flowing along the exhaust flow path P1 may be prevented from being reintroduced into the combustion chamber C.

Additionally, according to an embodiment of the present disclosure, as the barrier member 240 forms the exhaust flow path P, a contact area between the heated air and the rear wall 35 of the frame 21 can be reduced so as to prevent the enamel coating layer coated on the rear wall 35 of the frame 21 from being damaged.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking device, comprising:

a frame to form a cooking chamber;

a burner cover provided in the frame to form a combustion chamber;

a burner provided inside the combustion chamber;

the burner cover comprising a first cover covering a front of the burner and a second cover such that at least a portion of the second cover covers a rear of the burner, wherein the first cover includes a first opening through which air from within the cooking chamber passes and the second cover includes a second opening through which air heated by the burner in the combustion chamber exits the burner cover; and a barrier member provided between the burner cover and a rear wall of the frame to form an exhaust flow path for the heated air to prevent damage to the rear wall of the frame by the heat of air discharged from the combustion chamber, wherein air heated by the burner in the combustion chamber passes through the second hole, passes through the exhaust flow path between the burner cover and the barrier member, and is discharged to the cooking chamber.

2. The cooking device of claim 1, further comprising:
a fan motor provided outside of the frame; and
a fan connected to a shaft of the fan motor within the frame,
wherein the barrier member includes a shaft through-hole that receives the shaft.

3. The cooking device of claim 2, wherein:
the fan is provided between the frame and the burner cover, and
the diameter of the shaft through-hole is larger than the diameter of the fan.

4. The cooking device of claim 2, wherein:
the barrier member includes a vertical part and an inclination part that is inclined relative to the vertical part, and
the shaft through-hole is provided in the inclination part.

5. The cooking device of claim 4, wherein:
an exhaust flow path is provided between the burner cover and the barrier member to guide air from the combustion chamber to the cooking chamber, and
the exhaust flow path is wider at the inclination part than at the vertical part.

6. The cooking device of claim 5, wherein the width of the exhaust flow path decreases from a part adjacent to the shaft through-hole of the inclination part to the vertical part.

7. The cooking device of claim 1, wherein the barrier member is attached to the frame.

8. The cooking device of claim 7, wherein the barrier member includes:
a barrier plate that contacts the frame; and
a cover fastener extending from the barrier plate, whereby the cover fastener is configured to fasten with the burner cover.

9. The cooking device of claim 8, wherein the cover fastener includes:
an extension portion that extends from the barrier plate; and
a fastening body that is bent from an end of the extension portion, whereby the fastening body is configured to fasten with the burner cover.

10. The cooking device of claim 9, wherein the extension portion includes a strength reinforcement unit.

11. The cooking device of claim 8, wherein a strength reinforcement unit for strength reinforcement is formed on a portion of the barrier plate where the burner fastener is located.

12. The cooking device of claim 8, wherein:
the fastening body includes a fastening hole that is configured to fasten with a fastening member, and
the burner cover includes a first cover and a second cover, whereby the fastening member passes through the first and second covers and is fastened with the fasting hole.

13. The cooking device of claim 12, wherein the opening of the burner cover includes a first opening provided in the first cover and a second opening provided in the second cover.

14. The cooking device of claim 1, wherein the barrier member further includes a burner through-hole through which the burner passes.

15. The cooking device of claim 14, further comprising:
an ignition unit to ignite a mixed gas, the ignition unit having a wire connected thereto, and
a flange formed in the barrier plate, the flange configured to prevent damage to the wire.

16. A cooking device, comprising:
a frame to form a cooking chamber;
a burner cover provided in the frame to form a combustion chamber;
a burner provided inside the combustion chamber;
the burner cover comprising a first cover covering a front of the burner and a second cover such that at least a portion of the second cover covers a rear of the burner, wherein the first cover includes a first opening through which air from within the cooking chamber passes and the second cover includes a second opening through which air heated by the burner in the combustion chamber exits the burner cover;
a barrier member attached to the frame to form an exhaust flow path for the heated air to prevent damage to the rear wall of the frame by the heat of air discharged from the combustion chamber;
a fan motor provided outside of the frame, the fan motor having a shaft connected thereto that passes through the frame and the barrier member;
a fan connected to the shaft of the fan motor, the fan being disposed between the burner cover and the frame; and
wherein the burner cover is attached to the barrier member within the frame and spaced apart from the frame such that air heated by the burner in the combustion chamber passes through the second hole, passes through the exhaust flow path between the burner cover and the barrier member, and is discharged to the cooking chamber.

17. The cooking device of claim 16, wherein the barrier member comprises:
a barrier plate that contacts the frame; and
a cover fastener extending from the barrier plate, whereby the cover fastener is configured to fasten with the burner cover.

18. The cooking device of claim 17, wherein:
the barrier member includes a shaft through-hole to receive the shaft of the fan motor, and
the diameter of the shaft through-hole is larger than the diameter of the fan.

19. The cooking device of claim 17, wherein:
the burner cover includes an opening through which air heated by the burner passes, and
a horizontal distance between the shaft through-hole and the opening is less than a horizontal length of the cover fastener.

20. The cooking device of claim 17, further comprising:
an extension portion that extends from the barrier plate; and
a fastening body that is bent from an end of the extension portion, whereby the fastening body is configured to fasten with the burner cover.

* * * * *